US006182651B1

(12) United States Patent
Törnsten

(10) Patent No.: US 6,182,651 B1
(45) Date of Patent: Feb. 6, 2001

(54) OPEN AIR STOVE

(75) Inventor: Anders Törnsten, Solna (SE)

(73) Assignee: Primus AB, Solna (SE)

( * ) Notice: Under 35 U.S.C. 154(b), the term of this patent shall be extended for 0 days.

(21) Appl. No.: 09/462,724

(22) PCT Filed: Jul. 13, 1998

(86) PCT No.: PCT/SE98/01379

§ 371 Date: Jan. 12, 2000

§ 102(e) Date: Jan. 12, 2000

(87) PCT Pub. No.: WO99/04200

PCT Pub. Date: Jan. 28, 1999

(30) Foreign Application Priority Data

Jul. 14, 1997 (SE) ..... 9702714

(51) Int. Cl.[7] ..... F24C 1/02; F24C 1/16; F23D 17/00; F23D 11/44; F23D 14/28

(52) U.S. Cl. ..... 126/38; 431/247; 431/156; 431/344

(58) Field of Search ..... 126/38, 40; 431/247, 431/344, 156; 137/269; 251/144, 149.8

(56) References Cited

U.S. PATENT DOCUMENTS 1,947,194 * 2/1934 Engh ..... 431/156
2,469,185 * 5/1949 Tullis ..... 126/38
2,478,364 * 8/1949 Bramming ..... 126/38
2,538,538 * 1/1951 Stempel et al. ..... 126/38
5,803,727 * 9/1998 Long ..... 431/247

FOREIGN PATENT DOCUMENTS

2807922 * 8/1979 (DE) .
3718994 * 12/1988 (DE) .
3900333 * 5/1990 (DE) .
1293662 * 4/1962 (FR) .
97424 * 11/1939 (SE) .

* cited by examiner

*Primary Examiner*—Ira S. Lazarus
*Assistant Examiner*—Sara Clarke
(74) *Attorney, Agent, or Firm*—Rockey, Milnamow & Katz, Ltd.

(57) ABSTRACT

An open air stove comprises a fuel supply line which can be connected to a fuel source, a fuel nozzle which is connected to one end of said supply line and which extends into a cylindrical inner part of an inner cup. The inner cup is mounted concentrically in a partially cylindrical outer cup, so that the cylindrical part of the inner cup extends at least partially into the cylindrical part of the outer cup. The relationship between the nozzle hole diameter $\phi_m$, the inner diameter $\phi$ of the cylindrical part of the inner cup, and the inner diameter $\phi_y$ of the cylindrical part of the outer cup is such that when $\phi_m$ lies in the range of 0.28–0.37 mm $\phi_i$ will have the value 24 +/−5 mm and $\phi_y$ will have the value 60 +5/−10 mm.

10 Claims, 3 Drawing Sheets

OPEN AIR STOVE

FIELD OF INVENTION

The present invention relates to open air stoves that use connectable fuel sources.

BACKGROUND OF THE INVENTION

These open air stoves either use gaseous fuels such as bottled gas for instance, which is a mixture of propane and butane, or some other type of liquid fuel, such as paraffin, ethanol, diesel, methanol or gasoline. Stoves that use bottled gas must be of an approved type, and must fulfil certain requirements with respect to temperature values and emission values in order to be approved. Stoves that have been constructed for liquid fuels do not have to meet corresponding requirements, and hence construction of such stoves has been directed solely towards either gas-fired stoves or solely towards stoves that are fired with liquid fuels. A stove that has been constructed for bottled gas is not suitable for use with paraffin, since the stove has been constructed with a starting point from a liquid fuel source. The type of fuel source for which the stove is constructed controls geometries with respect to vaporisation loop, fuel pipe diameters, nozzle design, the diameter of the nozzle orifice, air holes, etc.

It might be possible to use a stove designed for gaseous fuels with the aforesaid liquid fuels as a fuel source, provided that certain modifications were made with respect to coupling of of the fuel sources, although this would result in a very large difference between the power generated by the stove when using liquid fuel that has a high air requirement (paraffin, diesel) and when using bottled gas, and the stove would be very difficult to ignite. Consequently, a modified construction of this kind is completely uninteresting to the user. From a user aspect, a stove that is operated on gaseous or liquid fuels will preferably be able to heat 1 liter of water to a temperature of 20° C. in a maximum of 3–4 minutes, regardless of the type of fuel used. The stove shall also be compact, so as to enable it to be tucked away in a small space, and will also achieve complete combustion as far as possible, so as to avoid sooting.

OBJECTS OF THE INVENTION

One object of the invention is to provide a stove that can be used either with gaseous fuels, such as bottled gas, or with paraffin, diesel, alcohol or gasoline . Another object is to provide such a stove that also fulfils the requirements laid down with respect to official approval of the type of stove concerned, and user requirements with respect to efficiency, flexibility, function, size and cleanliness.

SUMMARY OF THE INVENTION

In order to provide a stove which satisfies these objects, there is required a special combination of geometries in a special design of the stove, which means in the present case a unique combination of diameters on a cylindrical inner cup and diameters on a cylindrical outer cup, in combination with the diameter of the burner nozzle orifice. These geometries and special means for connecting different fuel sources constitute the present invention as defined in the following Claims.

BRIEF DESCRIPTION OF THE DRAWINGS

The present invention will now be described in more detail with reference to the accompanying drawings, in which reference signs have been included.

DESCRIPTION OF THE INVENTION

Figure 1:
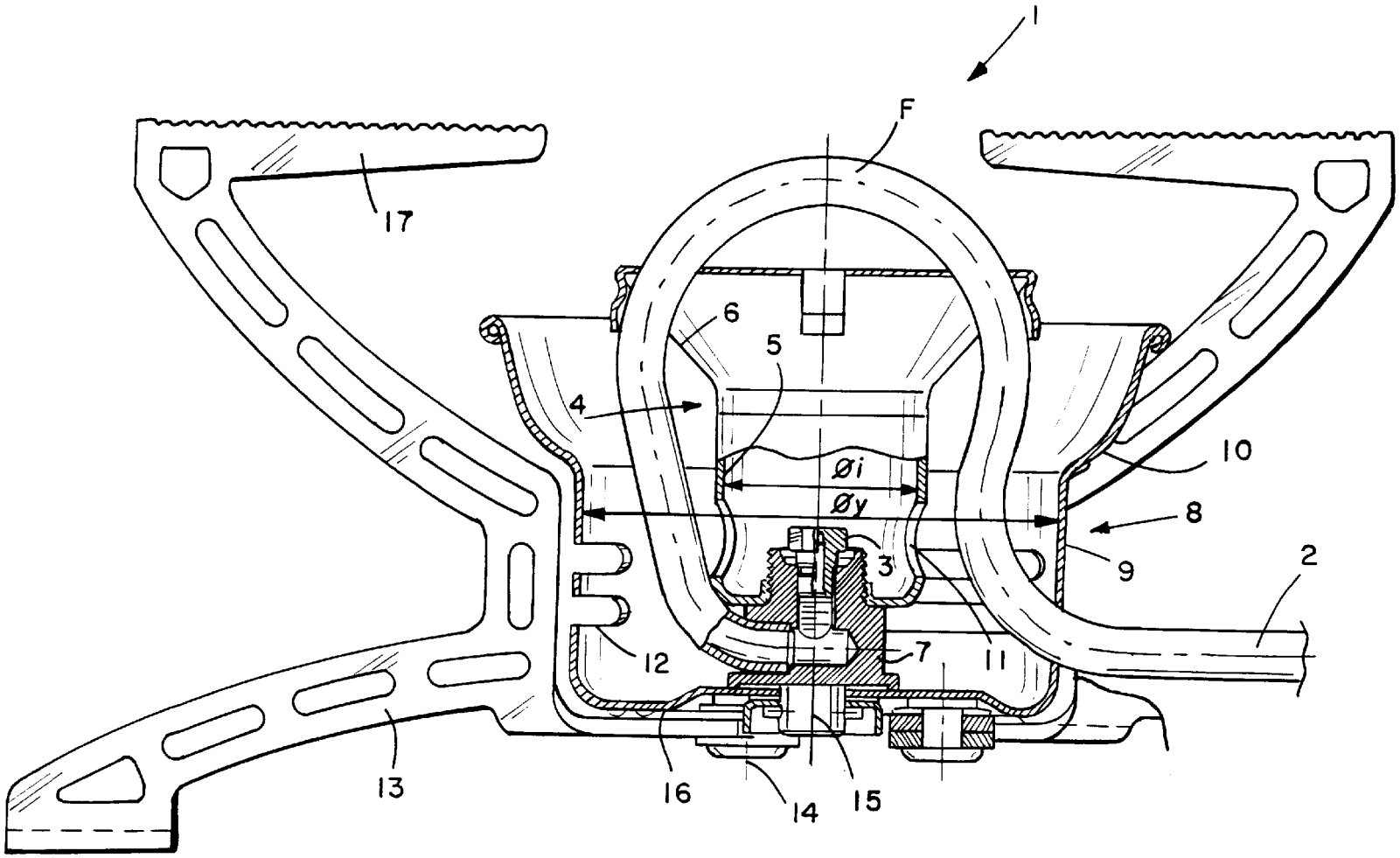
FIG. 1 is a sectional view of a stove according to the present invention.

FIG. 1 shows an open air stove 1 that includes a fuel supply line 2 whose one end is connected to a burner nozzle 3. The burner nozzle 3 is mounted at the bottom of an inner cup 4 that includes a lower cylindrical inner part 5 having an internal diameter $\phi_i$ and an upper funnel-shaped inner part 6. The burner nozzle and the end of the fuel supply line are mounted in a bottom piece 7 that extends into the inner cup 4 from beneath. The bottom piece also constitutes a spacer between the inner cup and an outer cup 8 mounted concentrically around said inner cup. The nozzle-carrying end of the fuel supply line 2 is provided with a vaopourization loop F whose upper part has a circle-sector shape.

The outer cup 8 also includes a lower cylindrical outer part 9 having an inner diameter $\phi_y$ and an upper funnel-shaped outer part 10. The cylindrical part of the inner cup has extending around its periphery a plurality of primary-air holes 11 through which combustion air is supplied. The cylindrical part of the outer cup is provided with air holes 12 through which primary air is supplied to the burner, secondary air is supplied to the flame, and combustion air is supplied in a pre-heating process.

The illustrated stove also includes at least three legs 13 which are mounted for pivotal movement about a respective pivot pin 14 arranged parallel with the cylindrical axis 15 of the inner cup at the bottom 16 of the outer cup. Each leg 13 has a vessel support means 17 attached permanently thereto. Thus, each leg and its associated vessel support means can be rotated about its pivot axis towards one side of the stove, so as to minimise the volume of the stove.

Figure 2:
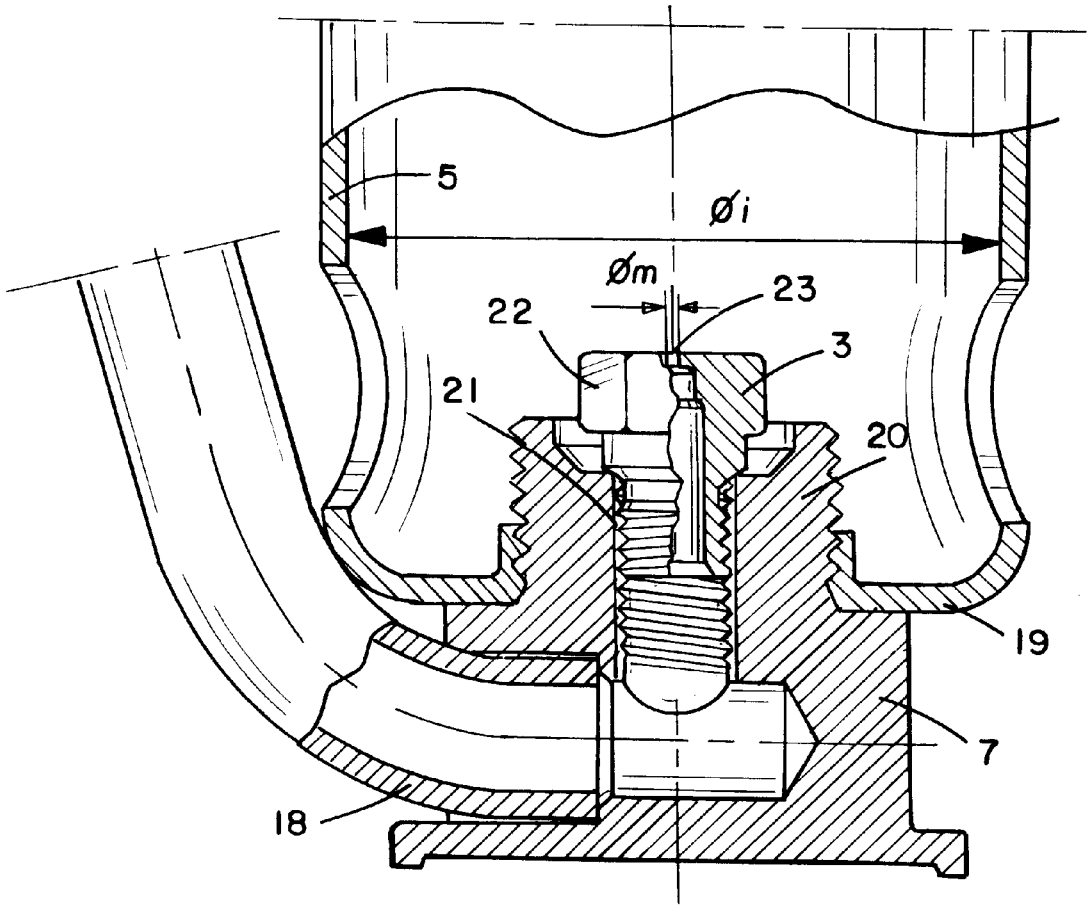
FIG. 2 is a sectional view of part of the connection of the burner nozzle shown in FIG. 1.

FIG. 2 illustrates a part of the rotational-symmetrical bottom piece 7 with the pressed-fitted end 18 of the fuel supply line 2 extending radially outwards from the bottom piece 7 beneath the bottom 19 of the inner cup 4. The bottom piece 7 includes a cylindrical neck 20 which extends in through the bottom 19 of the inner cup 4 and which is fitted concentrically in said inner cup. The burner nozzle 3 has a thread 21 and an hexagonal head 22, which enable the nozzle to be screwed down in the neck 20 of said bottom piece. The nozzle also includes a fuel hole 23 in its upper part. The hole diameter $\phi_m$ of the nozzle lies in the range of 0.28–0.37 mn.

Certain geometries are of decisive significance in providing a stove that has the properties mentioned in the introduction. These geometries are 1. The nozzle hole-diameter $\phi_m$;
2. The inner diameter $\phi_i$ of the cylindrical part of the inner cup; and
3. The inner diameter $\phi_y$ of the cylindrical part of the outer cup.

The relationship between the diameter $\phi_m$ of the fuel-hole 23 in the nozzle, the inner diameter $\phi_i$ of the cylindrical part 5 of the inner cup 4, and the inner diameter $\phi_y$ of the cylindrical part of the outer cup is such that when $\phi_m$ lies in the range of 0.28–0.37 mm, $\phi_i$ will have the value 24 +/−5 mm and $\phi_y$ will have the value 60 +5/−10 mm. The diameter measurements given above are optimum values. However, the values may deviate from the given optimum values to some extent without having a too deleterious effect on functional requirements. The range 0.28–0.37 mm means that the stove can be manufactured in different sizes for different powers, while still fulfilling the functional requirements. Different combinations between these three sets of values are conceivable, depending on which fuel is chosen as the primary fuel and which fuels are chosen as the secondary fuels. Since different fuels have different burning properties, a particular fuel is always chosen as the primary fuel from the aspect of construction.

The following designs are advantageous with respect to said geometries when $\phi_m$ lies in the range of 0.28–0.37 mm.

1. $\phi_i$ has the value 19–29 mm and $\phi_y$ has the value 50–65 mm
2. $\phi_i$ has the value 21–27 mm and $\phi_y$ has the value 53–64 mm
3. $\phi_i$ has the value 22–26 mm and $\phi_y$ has the value 55–63 mm
4. $\phi_i$ has the value 23–25 mm and $\phi_y$ has the value 58–62 mm
5. $\phi_i$ has the value 24 mm and $\phi_y$ has the value 60 mm The diameter $\phi_i$=24 mm and $\phi_y$=60 mm are optimum values with respect to power in relation to compactness. The diameter $\phi_i$ together with stove power determines the size of the primary-air holes 11.

The main functions of the outer and inner cups 8, 4 are directly related to the aforesaid geometries. The outer cup acts as a windshield; as an evaporation fuel storage means at the start; and as a radiation shield which retains heat for the vaporization loop on the one hand and, on the other hand, reduces radiation outside the cup; and as means for holding said legs and said nozzle, and to concentrate the flames around the vaporising tube when starting-up the stove. The inner cup functions as a flame holder, and as a means for mixing air and fuel (possibly vaporised), and to conduct heat to the attachment thereof so as to enhance the vaporisation. These functions are highly dependent on the dimensions of the outer cup 8 and the inner cup 4, in order to achieve optimum functioning of the stove and optimum combustion of the fuel.

Figure 3:
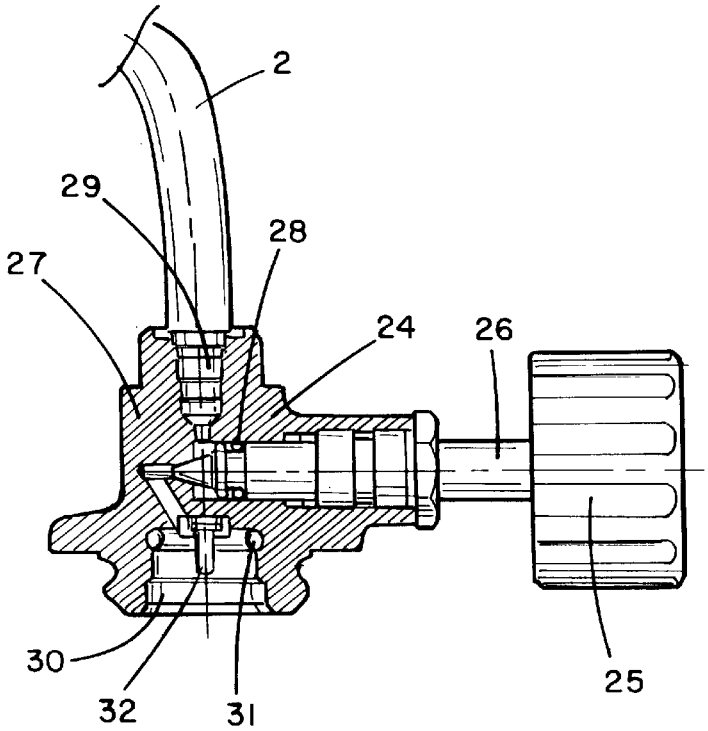
FIG. 3 is a sectional view of a regulating valve according to one embodiment of the invention.

The other end of the fuel line is connectable to a fuel source (not shown) via a regulating valve 24 (see FIG. 3) which controls the burning power of the stove by opening and throttling the fuel flow respectively. The regulating valve 24 includes a knob 25 attached to a valve spindle 26 which is sealed against a valve housing 27 by means of an O-ring 28. The fuel line 2 is connected to the valve housing 27 via a coupling 29, which may either be separable or fixed. In this regard, the fuel line 2 may be divided into a metal part proximal to the stove and be connected, via a coupling, to a flexible hose system for connection to the regulating valve. The valve housing also includes a fuel source connection 30, said connection including a seal 31 and an opening pin 32.

When the stove 1 is to be connected to a gas bottle, the regulating valve 24 is screwed directly onto the bottle and the opening pin 32 functions to open a check valve in the bottle in a conventional manner.

Figure 4:
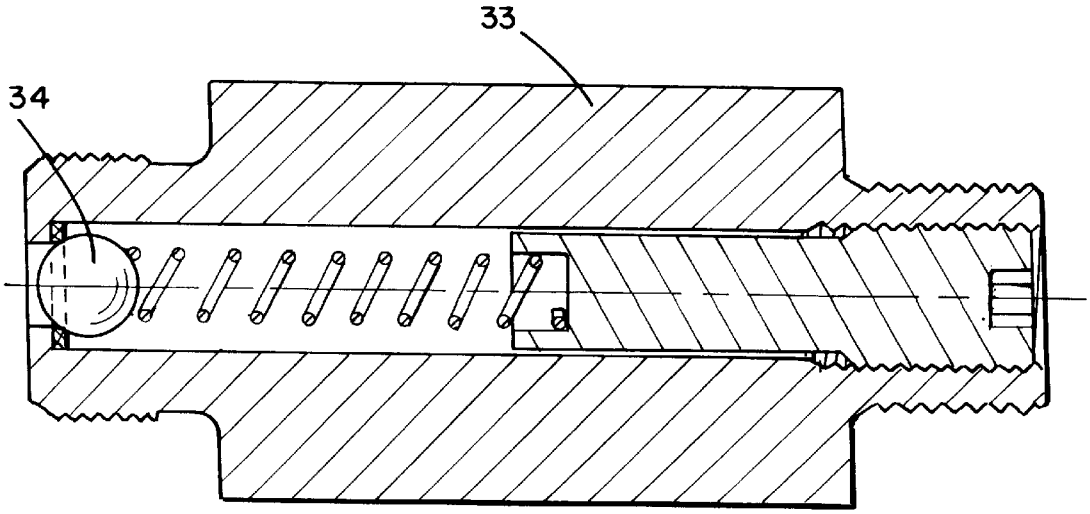
FIG. 4 illustrates an adapter for use in conjunction with the present invention.

When the stove 1 is to be connected to a conventional pump system for liquid fuel, the regulating valve 24 is screwed firmly to an adapter 33 (FIG. 4) which is designed for connection to the pump system, wherewith the opening pin 32 opens a check valve 34 in the adapter so that the pressurised fuel in the pump system will reach the valve and the flow of fuel to the stove regulated by said valve. The adapter is firmly connected to the pump system and functions to enable the system to be coupled to different fuel systems without needing to change the regulating valve and the hose system. When switching from a liquid fuel to a gaseous fuel, the regulating valve is unscrewed from the adapter 33, wherewith the check valve 34 closes and therewith prevents the pressurised liquid from flowing out from its container. The regulating valve is then screwed onto, e.g., a standard-type gas bottle. The stove can then be used as a gas stove, by opening the spindle 26 of the regulating valve 24. correspondingly, the check valve on the gas bottle is closed when the valve is unscrewed from the bottle.

I claim:

1. An open air stove which comprises a fuel supply line, one end of which can be connected to a fuel source and the other end of which includes a vaporisation loop, and which further comprises, at said other end of the fuel supply line, a burner nozzle, which has a nozzle hole defining a nozzle hole diameter $\phi_m$ and which extends into a cylindrical part of an inner cups said inner cup being mounted concentrically in a cylindrical part of an outer cup such that the cylindrical part of said inner cup extends at least partially into the cylindrical part of said outer cup, wherein the cylindrical part of the inner cup defines an inner diameter $\phi_i$ and the cylindrical part of the outer cup defines an inner diameter $\phi_y$ and wherein the stove is adapted for selective use either with gaseous fuel or with liquid fuel by virtue of the relationship among the nozzle hole diameter $\phi_m$, the inner diameter $\phi_i$ of the cylindrical part of said inner cup, and the inner diameter $\phi_y$ of the cylindrical part of said outer cup being such that $\phi_m$ lies in the range of 0.28–0.37 mm, $\phi_i$ has the value 24 +/−5 mm, and $\phi_y$ has the value 60 +5/−10 mm.

2. A stove according to claim 1, wherein each of the inner and outer cups has a symmetry axis and wherein the burner nozzle is cylindrical and has a symmetry axis, which is parallel with the symmetry axis of the inner cup and with the symmetry axis of the outer cup.

3. A stove according to claim 1, wherein the burner nozzle hole faces in the direction of the symmetry axis of the burner nozzle.

4. A stove according to any one of claims 1–3, wherein a major part of the vaporisation loop is placed in a space between the outer cup and the inner cup.

5. A stove according to any one of claims 1–3, wherein the fuel supply line at the end that can be connected to the fuel source, carries a regulating valve for regulating the amount of fuel supplied to the stove.

6. A stove according to claim 5, wherein the regulating valve can be connected to an adapter, which includes a check valve and which is firmly connected to a liquid fuel pump system.

7. A stove according to claim 5, wherein the regulating valve can be connected to a gas-bottle fuel source.

8. A stove according to any one of claims 1–3, wherein the outer cup has a bottom, wherein at least three legs are pivotally mounted on the bottom of the outer cup on respective pivot pins, and wherein each of said legs has a vessel support means firmly connected thereto.

9. A stove according to claim 8, wherein at least two of said legs can be swung around the periphery of the outer cup to one side thereof, so as to minimise the volume of the stove.

10. A stove according to any one of claims 1–3, wherein the inner cup and the outer cup widen into a funnel-shaped inner part and a funnel-shaped outer part respectively at their upper ends.

* * * * *

UNITED STATES PATENT AND TRADEMARK OFFICE

CERTIFICATE OF CORRECTION

PATENT NO. : 6,182,651 B1
DATED : February 6, 2001
INVENTOR(S) : Anders Törsten

It is certified that error appears in the above-identified patent and that said Letters Patent is hereby corrected as shown below:

Abstract,
Line 9, "Φ" should read -- $\Phi_i$ --.

Column 4,
Line 10, "correspondingly" should read -- Correspondingly --.

Claim 1,
Line 7, "cups said" should read -- cup, said --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*